US009441170B2

(12) United States Patent
Gordon et al.

(10) Patent No.: US 9,441,170 B2
(45) Date of Patent: Sep. 13, 2016

(54) DEVICE AND METHOD FOR UPGRADING PETROLEUM FEEDSTOCKS AND PETROLEUM REFINERY STREAMS USING AN ALKALI METAL CONDUCTIVE MEMBRANE

(71) Applicant: FIELD UPGRADING LIMITED, Calgary (CA)

(72) Inventors: John Howard Gordon, Salt Lake City, UT (US); Javier Alvare, Cottonwood Heights, UT (US)

(73) Assignee: FIELD UPGRADING LIMITED, Calgary (CA)

( * ) Notice: Subject to any disclaimer, the term of this patent is extended or adjusted under 35 U.S.C. 154(b) by 502 days.

(21) Appl. No.: 13/679,696

(22) Filed: Nov. 16, 2012

(65) Prior Publication Data

US 2014/0138284 A1 May 22, 2014

(51) Int. Cl.
*C10G 29/04* (2006.01)
*C10G 32/02* (2006.01)

(52) U.S. Cl.
CPC ..... *C10G 29/04* (2013.01); *C10G 32/02* (2013.01); *C10G 2300/1033* (2013.01); *C10G 2300/202* (2013.01); *C10G 2300/205* (2013.01)

(58) Field of Classification Search
CPC C10G 29/04; C10G 32/02; C10G 2300/205; C10G 2300/202; C10G 2300/1033
See application file for complete search history.

(56) References Cited

U.S. PATENT DOCUMENTS

| | | | | |
|---|---|---|---|---|
| 1,501,756 | A | 7/1924 | Downs | |
| 2,055,210 | A | 9/1936 | Vose | |
| 2,249,340 | A | 7/1941 | Wilson | |
| 2,772,211 | A * | 11/1956 | Hawkes et al. | 208/229 |
| 2,836,633 | A | 5/1958 | Esmay | |
| 3,497,569 | A | 2/1970 | Stiles et al. | |

(Continued)

FOREIGN PATENT DOCUMENTS

| | | |
|---|---|---|
| CA | 2531262 A1 | 6/2007 |
| DE | 2558505 | 11/1976 |

(Continued)

OTHER PUBLICATIONS

Reggel, et al., "Desulphurization of Gasoline by Metallic Sodium", *Fuel*, vol. 55, (Jul. 1976),170-172.

(Continued)

*Primary Examiner* — Randy Boyer
*Assistant Examiner* — Juan Valencia
(74) *Attorney, Agent, or Firm* — Foley & Lardner LLP

(57) ABSTRACT

A reactor has two chambers, namely an oil feedstock chamber and a source chamber. An ion separator separates the oil feedstock chamber from the source chamber, wherein the ion separator allows alkali metal ions to pass from the source chamber, through the ion separator, and into the oil feedstock chamber. A cathode is at least partially housed within the oil feedstock chamber and an anode is at least partially housed within the source chamber. A quantity of an oil feedstock is within the oil feedstock chamber, the oil feedstock comprising at least one carbon atom and a heteroatom and/or one or more heavy metals, the oil feedstock further comprising naphthenic acid. When the alkali metal ion enters the oil feedstock chamber, the alkali metal reacts with the heteroatom, the heavy metals and/or the naphthenic acid, wherein the reaction with the alkali metal forms inorganic products.

16 Claims, 7 Drawing Sheets

(56) References Cited

U.S. PATENT DOCUMENTS

| | | | | |
|---|---|---|---|---|
| 3,785,965 | A | 1/1974 | Welty | |
| 3,787,315 | A | 1/1974 | Bearden, Jr. et al. | |
| 3,788,978 | A | 1/1974 | Bearden, Jr. et al. | |
| 3,791,966 | A | 2/1974 | Bearden | |
| 3,960,708 | A | 6/1976 | McCollum et al. | |
| 4,076,613 | A | 2/1978 | Bearden, Jr. | |
| 4,428,828 | A | 1/1984 | Bose | |
| 4,454,017 | A | 6/1984 | Swanson | |
| 4,500,414 | A | 2/1985 | Audeh | |
| 4,501,652 | A | 2/1985 | Le et al. | |
| 4,606,812 | A | 8/1986 | Swanson | |
| 5,328,577 | A | 7/1994 | Murphy | |
| 5,695,632 | A | 12/1997 | Brons et al. | |
| 5,750,814 | A | 5/1998 | Grootjans et al. | |
| 5,935,419 | A | 8/1999 | Khan et al. | |
| 5,935,421 | A | 8/1999 | Brons et al. | |
| 6,132,590 | A | 10/2000 | Moran et al. | |
| 6,210,564 | B1 | 4/2001 | Brons et al. | |
| 6,280,128 | B1 | 8/2001 | Schrader | |
| 6,368,486 | B1 * | 4/2002 | Thompson et al. | 205/406 |
| 6,413,898 | B1 | 7/2002 | Faber et al. | |
| 6,635,795 | B2 | 10/2003 | Gislason et al. | |
| 6,697,987 | B2 * | 2/2004 | Lee et al. | 714/751 |
| 6,706,902 | B2 | 3/2004 | Sturmann et al. | |
| 6,734,133 | B1 | 5/2004 | Weisbeck et al. | |
| 6,787,019 | B2 | 9/2004 | Jacobson et al. | |
| 7,504,023 | B2 | 3/2009 | Pravia et al. | |
| 7,897,028 | B2 | 3/2011 | Gordon et al. | |
| 8,088,270 | B2 | 1/2012 | Gordon et al. | |
| 8,828,220 | B2 | 9/2014 | Gordon | |
| 2002/0011430 | A1 | 1/2002 | Greaney | |
| 2002/0125175 | A1 | 9/2002 | Collins et al. | |
| 2005/0145545 | A1 | 7/2005 | Schucker | |
| 2005/0161340 | A1 | 7/2005 | Gordon et al. | |
| 2006/0054538 | A1 | 3/2006 | Hsu et al. | |
| 2006/0138029 | A1 | 6/2006 | Malek et al. | |
| 2007/0087934 | A1 | 4/2007 | Martens et al. | |
| 2008/0031792 | A1 | 2/2008 | Ciccarelli et al. | |
| 2008/0251422 | A1 | 10/2008 | Baez et al. | |
| 2009/0134040 | A1 | 5/2009 | Gordon et al. | |
| 2009/0134059 | A1 | 5/2009 | Myers et al. | |
| 2009/0259082 | A1 | 10/2009 | Deluga et al. | |
| 2010/0089762 | A1 | 4/2010 | Gordon | |
| 2010/0155298 | A1 | 6/2010 | Raterman et al. | |
| 2010/0187124 | A1 | 7/2010 | Koveal | |
| 2010/0276335 | A1 | 11/2010 | Shucker | |
| 2010/0297531 | A1 | 11/2010 | Liu et al. | |
| 2010/0297537 | A1 | 11/2010 | Coors et al. | |
| 2010/0304953 | A1 | 12/2010 | Liu et al. | |
| 2011/0054232 | A1 | 3/2011 | Sangar et al. | |
| 2011/0100874 | A1 | 5/2011 | Gordon | |
| 2011/0119994 | A1 | 5/2011 | Hogendoorn et al. | |
| 2011/0155647 | A1 | 6/2011 | Serban et al. | |
| 2012/0304530 | A1 | 12/2012 | Chitta et al. | |
| 2013/0043160 | A1 | 2/2013 | Gordon | |
| 2013/0140217 | A1 | 6/2013 | Gordon et al. | |
| 2013/0153469 | A1 | 6/2013 | Gordon | |

FOREIGN PATENT DOCUMENTS

| | | |
|---|---|---|
| KR | 2006-0032194 | 4/2006 |
| WO | WO-02099013 | 12/2002 |
| WO | WO2010016899 | 1/2010 |
| WO | WO-2010124030 | 10/2010 |
| WO | WO-2011012900 | 2/2011 |
| WO | WO2011053919 | 9/2011 |
| WO | WO2012147097 | 11/2012 |
| WO | WO2013019596 | 2/2013 |

OTHER PUBLICATIONS

Byun, Sang H., "International Search Report", International Search Report for PCT US 2010/054984 (Corresponding to U.S. Appl. No. 12/916,984), (Jul. 28, 2011),1-3.

Byun, Sang H., "Written Opinion of the International Searching Authority", Written Opinion for PCT US 2010/054984 (Corresponding to U.S. Appl. No. 12/916,984), (Jul. 28, 2011),1-5.

Kabe, T. et al., "Hydrodesulfurization and Hydrodenitrogenation", Wiley-VCH (1999), (1999),110-112.

Task Force on Strat. Uncnv. Fuel, "America's Strategic Unconventional Fuels, vol. III Resource and Technology Profiles", *America's Strategic Unconventional Fuels*, vol. III Resource and Technology Profiles (completed Feb. 2007, Published Sep. 2007)., Full text available at http://www.unconventionalfuels.org/publications/reports/Volume_III_ResourceTechProfiles(Final).pdf,(Sep. 2007),III-25.

Lee, Young W., "International Search Report", PCT/US/2012/039388 (corresponding to U.S. Appl. No. 12/916,948), (Dec. 27, 2012),1-3.

Lee, Young W., "Written Opinion of the International Searching Authority", PCT/US/2012/039388 (corresponding to U.S. Appl. No. 12/916,948), (Dec. 27, 2012),1-3.

Hwang, Yun K., "International Search Report", PCT App. No. PCT/US2012/065670 (corresponding to U.S. Appl. No. 13/679,696), (Apr. 1, 2013),1-4.

Hwang, Yun K., "Written Opinion of the International Searching Authority", PCT App. No. PCT/US2012/065670 (corresponding to U.S. Appl. No. 13/679,696), (Apr. 1, 2013),1-8.

Valencia, Juan C., "Non-Final Office Action", U.S. Appl. No. 12/916,984, (Mar. 25, 2013),1-10.

Sternberg, et al., "On the Solubilization of Coal via Reductive Alkylation", Preprints of Papers—American Chemical Society, Division of Fuel Chemistry (1970), 14(1), (available to the public 1984), (1984),87-94.

Bentor, Yinon "Chemical Element.com—Sodium", http://www.chemicalelement.com/elements/na.html, (1996),1-3.

"Non Final Office Action", Chinese Application No. 201080049770.5, (Dec. 4, 2013),1-18.

"Non Final Office Action", Chinese Application No. 201080049770.5, (Dec. 4, 2013)1-18.

Valencia, Juan C., "Notice of Allowance", U.S. Appl. No. 12/916,984, (May 7, 2014),1-9.

Valencia, Juan C., "Notice of Allowance", U.S. Appl. No. 13/550,313, (May 8, 2014),1-8.

Lee, Dong W., "International Search Report", PCT/US2013/023850 (Corresponding to U.S. Appl. No. 13/753,918), (May 14, 2013),1-3.

Lee, Dong W., "Written Opinion of the International Searching Authority", PCT/US2013/023850 (Corresponding to U.S. Appl. No. 13/753,918), (May 14, 2013),1-5.

Wood, Elizabeth D., "Non-Final Office Action", U.S. Appl. No. 13/497,057, (Jul. 15, 2013),1-7.

"Natural Gas", http://www.gasenergia.com.br/portal/ing/gasnatural/dadostecnicos.jsp, (Jun. 10, 2004),1-20.

Sternberg, et al., "Solubilization of Coal via Reductive Alkylation", Preprints of Papers—American Chemical Society, Division of Fuel Chemistry (1970), 14(1), 87-94 (available to the public 1984) CODEN: ACFPAI, ISSN: 0569-3772, (1970),87-94.

Valencia, Juan C., "Non-Final Office Action", U.S. Appl. No. 12/916,984, (Sep. 10, 2013),1-10.

Valencia, Juan C., "Non Final Office Action", U.S. Appl. No. 13/550,313, (Sep. 10, 2013),1-12.

Lee, Dong W., "International Search Report", PCT Application No PCT/US1350194 (Corresponding to U.S. Appl. No. 13/940,336), (Nov. 5, 2013),1-5.

Lee, Dong W., "Written Opinion of the International Searching Authority", PCT Application No. PCT/US1350194 (Corresponding to U.S. Appl. No. 13/940,336), (Nov. 5, 2013),1-5.

Lee, Dong W., "International Search Report", PCT Application No. PCT/US2013/026698 (Corresponding to U.S. Appl. No. 13/770,610), (Aug. 19, 2013),1-5.

Lee, Dong W., "Written Opinion of the International Searching Authority", PCT Application No. PCT/US2013/026698 (Corresponding to U.S. Appl. No. 13/770,610), (Aug. 19, 2013),1-5.

Oh, Eung G., "International Search Report", PCT Application No. PCT/US2014/034183 (Corresponding to U.S. Appl. No. 14/253,286), (Aug. 11, 2014),1-3.

(56) References Cited

OTHER PUBLICATIONS

Oh, Eung G., "Written Opinion of the International Searching Authority", PCT Application No. PCT/US2014/034183 (Corresponding to U.S. Appl. No. 14/253,286), (Aug. 11, 2014),1-6.
Lee, Chang H., "International Search Report", PCT Application No. PCT/US2014/027292 (Corresponding to U.S. Appl. No. 14/210,891), (Jul. 8, 2014),1-3.
Lee, Chang H., "Written Opinion of the International Search Authority", PCT Application No. PCT/US2014/027292 (Corresponding to U.S. Appl. No. 14/210,891), (Jul. 8, 2014),1-5.
Aizawa, Keisuke "Non-Final Office Action", Japanese Application No. 2012537170, (Aug. 26, 2014),1-6.
Lachman, Richard "Supplementary European Search Report", (Nov. 11, 2014),1-7.
"Non Final Office Action", Chinese Application No. 201080049770.5, (Jul. 1, 2014),1-4.
"Notice on Grant of Patent Right for Invention", Chinese Patent Application No. 201080049770.5, (Oct. 10, 2014),1-4.
Bearden, "Bibliographic Data", German Patent Publication DE2558505, (Nov. 18, 1976),1.
Francis, Humblot "Bibliographic data and English Abstract", Korean Patent Publication KR20060032194, (Apr. 14, 2006),1.
Valencia, Juan C., "Notice of Allowance", U.S. Appl. No. 13/753,918, (Nov. 20, 2013),1-18.
Yu, Jianfei et al., "High temperature naphthenic acid corrosion of steel in high TAN refining media", *Anti-Corrosion Methods and Materials*, vol. 55 Issue 5, (2008), 257-63.
Wang, Chen et al., "High Temperature Naphthenic Acid Corrosion of Typical Steels", *Canadian Journal on Mechanical Sciences and Engineering* vol. 2, No. 2, (Feb. 1, 2011), 23-30.
Seo, Sang Y., "International Search Report", PCT App. No. PCT/US2012/046939 (Corresponding to U.S. Appl. No. 13/550,313), (Jan. 31, 2013), 1-3.
Seo, Sang Y., "Written Opinion of the International Searching Authority", PCT App. No. PCT/US2012/046939 (Corresponding to U.S. Appl. No. 13/550,313), (Jan. 31, 2013), 1-6.
Extended European Search Report dated Dec. 7, 2015 on EP 10827610.6 (8 pages).
Examiner's Report dated Dec. 18, 2015 for CA Appl 2769863. 4 pages.
Extended European Search Report dated Nov. 2, 2015 on EP 13744384.2 (6 pages).
International Preliminary Report on Patentability and Written Opinion dated Oct. 29, 2015 on PCT/US2014/034183, 6 pages.
US Office Action dated Dec. 3, 2015, 16 pages.
Extended European Search Report dated May 30, 2016, in related application EP 13855801.0.
US Notice of Allowance on U.S. Appl. No. 13/770,610 DTD May 4, 2016.

* cited by examiner

DEVICE AND METHOD FOR UPGRADING PETROLEUM FEEDSTOCKS AND PETROLEUM REFINERY STREAMS USING AN ALKALI METAL CONDUCTIVE MEMBRANE

U.S. GOVERNMENT INTEREST

This invention was made with government support under Contract No. DE-FE0000408 awarded by the U.S. Department of Energy. The government has certain rights in the invention.

RELATED APPLICATIONS

This application claims the benefit of U.S. Provisional Patent Application Ser. No. 61/560,653 filed Nov. 16, 2011, which is expressly incorporated herein by reference.

TECHNICAL FIELD

The present disclosure relates to a process for removing nitrogen, sulfur, heavy metals, and acid protons from sulfur-, nitrogen-, and metal-bearing shale oil, bitumen, heavy oil and petroleum refinery streams so that these materials may be used as a hydrocarbon fuel. More specifically, the present disclosure relates to removing nitrogen, sulfur, heavy metals and acid protons from shale oil, bitumen, heavy oil, or petroleum refinery streams while at the same time, upgrading these materials to have a higher hydrogen-to-carbon ratio.

BACKGROUND

U.S. patent application Ser. No. 12/916,984 (which has been incorporated herein by reference) has been published as United States Patent Application Publication No. 2011/0100874. The reader is presumed to be familiar with the disclosure of this published application. This published application will be referred to herein as the "874 application."

The demand for energy (and the hydrocarbons from which that energy is derived) is continually rising. However, hydrocarbon raw materials used to provide this energy often contain difficult-to-remove sulfur and metals. For example, sulfur can cause air pollution and can poison catalysts designed to remove hydrocarbons and nitrogen oxide from motor vehicle exhaust, necessitating the need for expensive processes used to remove the sulfur from the hydrocarbon raw materials before it is allowed to be used as a fuel. Further, metals (such as heavy metals) are often found in the hydrocarbon raw materials. These heavy metals can poison catalysts that are typically utilized to remove the sulfur from hydrocarbons. To remove these metals, further processing of the hydrocarbons is required, thereby further increasing expenses.

Currently, there is an on-going search for new energy sources in order to reduce the United States' dependence on foreign oil. It has been hypothesized that extensive reserves of shale oil, which constitutes oil retorted from oil shale minerals, will play an increasingly significant role in meeting this country's future energy needs. In the U.S., over 1 trillion barrels of usable, reserve shale oil are found in a relatively small area known as the Green River Formation located in Colorado, Utah, and Wyoming. As the price of crude oil rises, these shale oil resources become more attractive as an alternative energy source. In order to utilize this resource, specific technical issues must be solved in order to allow such shale oil reserves to be used, in a cost effective manner, as hydrocarbon fuel. One issue associated with these materials is that they contain a relatively high level of nitrogen, sulfur and metals, which must be removed in order to allow this shale oil to function properly as a hydrocarbon fuel.

Other examples of potential hydrocarbon fuels that likewise require a removal of sulfur, nitrogen, or heavy metals are bitumen (which exists in ample quantities in Alberta, Canada) and heavy oils (such as are found in Venezuela).

The high level of nitrogen, sulfur, and heavy metals in shale oil, bitumen and heavy oil (which may collectively or individually be referred to as "oil feedstock") makes processing these materials difficult. Typically, these oil feedstock materials are refined to remove the sulfur, nitrogen and heavy metals through a process known as "hydro-treating."

Hydro-treating may be performed by treating the material with hydrogen gas at an elevated temperature and an elevated pressure using catalysts such as Co—Mo/$Al_2O_3$ or Ni—Mo/$Al_2O_3$.

In the present invention, the oil feedstock is mixed with an alkali metal (such as sodium) and hydrogen gas. This mixture is reacted under modest pressure (and usually at an elevated temperature). The sulfur and nitrogen atoms are chemically bonded to carbon atoms in the oil feedstocks. The sulfur and nitrogen heteroatoms are reduced by the alkali metals to form ionic salts (such as $Na_2S$, $Na_3N$, $Li_2S$, etc.). To prevent coking (e.g., a formation of a coal-like product), the reaction occurs in the presence of hydrogen gas that can form bonds with the carbon atoms of the oil feedstock previously bonded to the heteroatoms. The hydrogen atom bonds to the carbon atoms that were previously bonded to the heteroatoms, thereby increasing the hydrogen-to-carbon ratio of the oil feedstock and decreasing the heteroatom to carbon ratio of the resulting organic feedstock. After the hydro-treating reaction, the organic phase (oil feedstock) is less viscous and may be sent for further refining into a hydrocarbon fuel material.

The ionic salts formed in the hydro-treating process may be removed from the organic products by filtering, or first mixing the treated feedstock with hydrogen sulfide to form an alkali hydrosulfide, which forms a separate phase from the organic phase (oil feedstock). This reaction is shown below with sodium (Na) being the alkali metal, although other alkali metals may also be used:

$$Na_2S+H_2S \rightarrow 2NaHS \text{ (which is a liquid at 375° C.)}$$

$$Na_3N+3H_2S \rightarrow 3NaHS+NH_3$$

The nitrogen product is removed in the form of ammonia gas ($NH_3$) which may be vented and recovered, whereas the sulfur product is removed in the form of an alkali hydro sulfide, NaHS, which is separated for further processing. Any heavy metals will also be separated out from the organic hydrocarbons by gravimetric separation techniques.

As part of the process, alkali metals are used. An advantage of using alkali metals such as sodium or lithium instead of hydrogen to reduce the heteroatoms is alkali metals offer a greater reduction strength. In other words, the alkali metals are better able to reduce the heteroatoms and form alkali metal nitrides or alkali metal sulfides. Further, by using alkali metals, there is less need to saturate rings with hydrogen to destabilize them so that the heteroatoms can be reduced, making it possible to remove heteroatoms with significantly less hydrogen.

It should be noted that the alkali metal treatment process is known in the industry and is described, for example, in U.S. Pat. No. 3,787,315, U.S. Patent Application Publication No. 2009/0134040 and U.S. Patent Application Publication No. 2005/0161340. (These documents are expressly incorporated herein by reference.)

A disadvantage of using the hydro-treating process is that hydrogen gas is a necessary reactant needed for the hydro-treating process. However, hydrogen gas can be expensive. Typically, hydrogen gas is formed by reacting hydrocarbon molecules with water. For example, in the United States, 95% of the hydrogen is formed using the Steam-Methane Reforming Process from natural gas. In the first step known as the reforming step, methane ($CH_4$) in natural gas is reacted with steam ($H_2O$) at 750° C.-800° C. to produce synthesis gas (syngas). Syngas is a mixture primarily comprised of hydrogen gas ($H_2$) and carbon monoxide (CO). In the next step, known as the water gas shift reaction, the carbon monoxide produced in the first reaction is reacted with steam ($H_2O$) over a catalyst to form hydrogen gas ($H_2$) and carbon dioxide ($CO_2$). This second process (e.g., the water gas shift reaction) occurs in two stages: the first stage occurring around 350° C. and the second stage occurring at about 200° C.

The overall reaction for the Steam-Methane Reforming Process is as follows:

$$CH_4+2H_2O\rightarrow 4H_2+CO_2$$

Thus for every (theoretical) mole of hydrogen gas produced, 0.25 moles methane and 0.5 moles of water are required. Also, for every mole of hydrogen gas produced, 0.25 moles of carbon dioxide are produced and released to the atmosphere. It should be noted that the Steam-Methane Reforming Process is typically only 65-75% efficient. Thus at 70% efficiency, the Steam-Methane Reforming Process will actually utilizes 0.36 moles of methane and 0.71 moles of water while releasing 0.36 moles of carbon dioxide for every mole of hydrogen produced.

This production of carbon dioxide during the hydro-treating process is considered problematic by many environmentalists due to rising concern over carbon dioxide emissions and the impact such emissions may have on the environment.

An additional problem in many regions is the scarcity of water resources. For example, in the region of Western Colorado and Eastern Utah where parts of the Green River Formation of shale oil is located, the climate is arid and the use of water in forming hydrogen gas can be expensive.

Alternatively, some industrialists have used an electrolysis process to provide the hydrogen gas supply needed for their hydro-treating process. This electrolysis reaction involves the electrolytic decomposition of water. In this electrolytic reaction, water is split to form hydrogen at a cathode and oxygen at an anode:

$$H_2O\rightarrow H_2+1/2)_2$$

In this reaction, electrical energy is used to split the water. If the cell runs at 90% efficiency and runs at about 1.4 Volts, then the electrical energy required is about 72 kcal per mole of created hydrogen. For every mole of hydrogen produced in this electrolysis reaction, one mole of water is consumed. Because one mole of water is consumed to produce hydrogen in this method, more water is required to produce the hydrogen gas via electrolysis than is required to produce the hydrogen using the Steam-Methane Reforming Process (which requires 0.71 moles water). Thus, in arid climates where the cost of water is high, using an electrolysis process to produce hydrogen may not be economically feasible.

While conventional hydro-treating processes are known, they are expensive and require large capital investments in order to obtain a functioning hydro-treating plant. There is a need in the industry for a new process that may be used to remove heteroatoms such as sulfur and nitrogen from oil feedstocks, but that is less expensive than hydro-treating. Such a process is disclosed herein.

Additionally, naphthenic acids must be removed from many organic streams that are produced by refineries. Naphthenic acids ("NAPs") are carboxylic acids present in petroleum crude or various refinery streams. These acids are responsible for corrosion in refineries. A common measure of acidity of petroleum is called the Total Acid Number ("TAN") value and is defined as the milligrams (mg) of potassium hydroxide needed to neutralize the acid in one gram of the petroleum material. (Other acids found in the oil feedstock may also contribute to the TAN value). All petroleum streams with TAN >1 are called high TAN. NAPs are a mixture of many different compounds and cannot be separated via distillation. Moreover high TAN crudes are discounted over Brent Crude prices. For example, Doba crude with a TAN of 4.7 is discounted by $19 per barrel on a base price of $80 for Brent crude.

NAPs boil in the same range as that of kerosene/jet fuel. (However, kerosene/jet fuels have very stringent TAN specifications.) Attempting to neutralize these acids using aqueous caustic or other bases form salts. These salts in presence of water, lead to formation of stable emulsions. Additional methodologies of NAP reduction include hydrotreating or decarboxylation that are both destructive methodologies and the NAPs cannot be recovered using these methods. Solvent extraction or adsorption methodologies lead to high costs and energy usage for sorbent regeneration or solvent boiling. A new method for NAPs removal with lower energy consumption wherein NAPs can be recovered and processed as commercial products is required. Accordingly, a new method of neutralizing and/or removing NAPs is needed. Such a method and device is disclosed herein.

SUMMARY

The present embodiments include a method of upgrading an oil feedstock with the benefit of a strong alkali metal agent without directly being required to handle, store, or transport the alkali metal. The method comprises obtaining a quantity of an oil feedstock, the oil feedstock comprising at least one carbon atom and a heteroatom and/or one or more heavy metals. The quantity of the oil feedstock is reacted with an alkali metal generated on an electrode within the reactor. The reaction with the alkali metal may also include using an upgradant hydrocarbon such as hydrogen gas or a hydrocarbon.

In order to implement these embodiments, a reactor may be utilized with at least two chambers separated in part by a membrane conductive to alkali metal ions. This membrane conducts alkali metal ions from an alkali metal ion source material (such as a liquid comprised of sodium salts or sodium metal). A positive charged electrode (anode) is in communication with the alkali metal ion source. The opposite chamber of the reactor (called the feedstock chamber) includes a feedstock stream (comprised of the organic oil feedstock) and a negatively charged electrode (cathode). The alkali metal enters the feedstock chamber and reacts with the heteroatom and/or the heavy metals in the feedstock to form one or more inorganic products, wherein the upgradant hydrocarbon reacts with the oil feedstock to produce an upgraded oil feedstock. The reaction with the upgradent hydrocarbon operates such that the number of carbon atoms in the upgraded oil feedstock may be greater than the number of carbon atoms in the original oil feedstock. The inorganic products are then separated from the upgraded oil feedstock. (The reaction of the oil feedstock, the alkali metal, and the upgradant hydrocarbon molecule may be implemented with or without using hydrogen gas. If hydrogen gas is utilized, the amount of hydrogen gas needed is much less than would be required using conventional hydrotreating.)

In some embodiments, the alkali metal comprises sodium, lithium, or alloys of lithium and sodium. The upgradant hydrogen source may comprise hydrogen, natural gas, shale gas and/or mixtures thereof. In other embodiments, the upgradant hydrocarbon comprises methane, ethane, propane, butane, pentane, their isomers, ethene, propene, butene, pentene, dienes, and/or mixtures thereof. (Oil retort gas, which is a mixture of gases that is produced in a refinery process may also be used as the upgradant hydrocarbon.)

The process of reacting the feedstock with the alkali metal may consist of two steps. A first step involves having alkali metal ions be transferred across the membrane and reduced to metal at the membrane surface at a negatively charged electrode (which may be directly fixed to the membrane surface). A second step involves having the formed alkali metal react directly with the constituents in the oil feedstock (or carried away with the oil to react downstream). The electrode where the alkali metal is formed may be porous, or comprised of a mesh. In another embodiment, the electrode may be a film of metallic alkali metal connected to an electrical lead (or current collector). To maintain continuity, a screen or mesh may provide a divider to separate a zone where the alkali metal is reduced from the oil feedstock. This screen allows the alkali metal to pass through as it is formed.

The reaction between the alkali metal and the oil feedstock may occur at a pressure that is between barometric and about 2500 psi and/or at a temperature that is between about 100° C. temperature and 450° C. In other embodiments, the reaction between the alkali metal and the oil feedstock occurs at a temperature that is above the melting point of the alkali metal but is lower than 450° C. Further embodiments may utilize a catalyst in the reaction. The catalyst may comprise molybdenum, nickel, cobalt or alloys thereof, molybdenum oxide, nickel oxide or cobalt oxides and/or combinations thereof.

As the reaction between the alkali metal and the oil feedstock produces inorganic products, a separation step may be needed. The separation used in the process may occur in a separator, wherein the inorganic products form a phase that is separable from an organic phase that comprises the upgraded oil feedstock and/or unreacted oil feedstock. To facilitate this separation, a flux may be added to the separator. After separation, the alkali metal from the inorganic products may be regenerated and reused.

The upgraded oil feedstock produced in the reaction may have a greater hydrogen-to-carbon ratio than the oil feedstock. The upgraded oil feedstock produced in the reaction may also have a greater energy value than the oil feedstock. Further, the heteroatom-to-carbon ratio of the upgraded oil feedstock may be less than the heteroatom-to-carbon ratio of the oil feedstock.

Additional embodiments may be designed in which an alkali metal is added to the oil feedstock in order to reduce the TAN value of the oil feedstock. Specifically, the alkali metal may react with the oil feedstock to remove the acidic components, thereby lowering the TAN value. In some embodiments, the original (unreacted) oil feedstock may have a TAN value of greater than or equal to 1, but after reaction with the alkali metal, may have a TAN value of less than or equal to 1.

DETAILED DESCRIPTION

Figure 1:
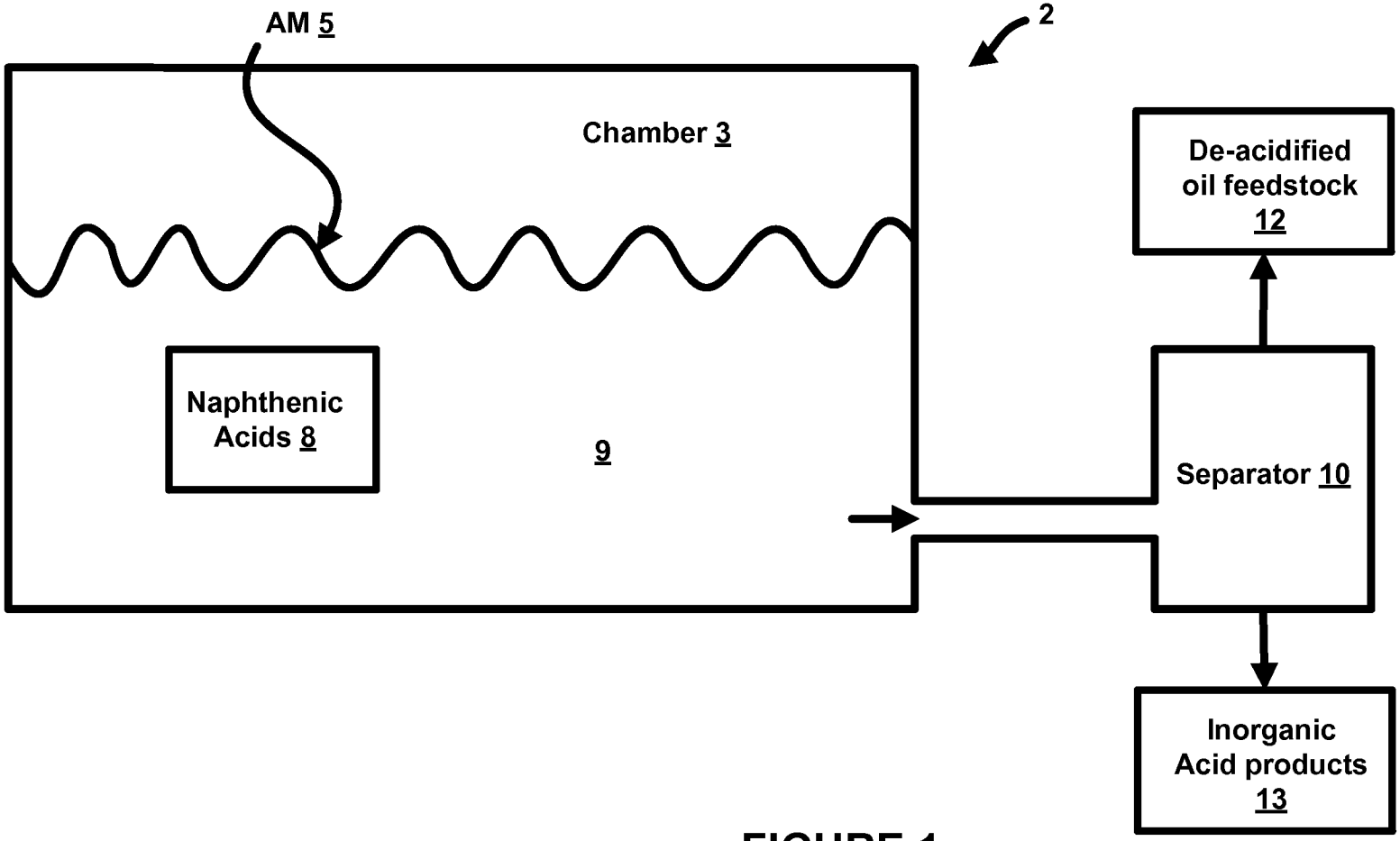
FIG. 1 shows a schematic drawing of a device that may be used to de-acidify a quantity of an oil feedstock.

The present embodiments relate to a method to de-acidify feedstocks and refinery streams. Such de-acidification is beneficial as it may operate to reduce piping corrosion and may convert naphthenic acids to a salt form. The present embodiments involve the addition of alkali metals (such as sodium or lithium metal) to the feedstocks as a means of reacting with the naphthenic acids, thereby de-acidifying these acids. When this reaction occurs, the naphthenic acids may be converted into the corresponding sodium or lithium salts (or other inorganic products). Hydrogen gas is also formed in this reaction. This reaction is summarized as follows:

$$R—COOH+Na \rightarrow (R—COO^-)Na^+ + 1/2\ H_2$$

Alternatively, the sodium may further react with oxygen atoms to eliminate the carboxyl group as shown in the following formula:

$$R—COOH+4Na+H_2 \rightarrow R—CH_3+2Na_2O$$

The reaction with NAPs in this manner may be desirable and may result in a reduction of Total Acid Number ("TAN") associated with the oil feedstock. There are multiple different ways in which the alkali metal may be added to the feedstock. In one embodiment, the sodium or lithium metal is directly added to the stream. Once this occurs, the inorganic products may then be filtered from the oil stream. Other embodiments may also be designed (as described herein) to provide other mechanisms for adding the alkali metal to the stream of oil feedstock (such as, for example, by forming the alkali metal in situ).

It should be noted that, in addition to reacting with the acids (such as naphthenic acids), the alkali metals that are added to the feedstock may also react to remove sulfur, nitrogen, metals (such as heavy metals), etc. This process for removing these metals/heteroatoms is discussed in the '874 application. Thus, by adding alkali metals to the oil feedstock, the problems associated with metals/heteroatoms in the stream, as well as problems with acids in the stream, may be overcome.

It should be noted that many in the oil processing industry are uncomfortable handling metallic sodium or lithium because of its reactive nature. In other words, these practitioners are uncomfortable using sodium/lithium and are uncomfortable adding these reagents directly to their oil feedstock streams. Accordingly, the present embodiments also provide methods and devices which operate to electrochemically produce alkali metals within an oil feedstock chamber (e.g., in situ), thereby bringing an alkali metal such as sodium in direct contact with the feedstock. Once this alkali metal is produced in the chamber, it is consumed by reacting with the heavy metals/heteroatoms and/or the acids in the feedstock. These embodiments may be desirable in that they provide the strong reducing power and reactivity associated with alkali metals without ever having an appreciable amount of the metal present. In other words, the present embodiments upgrade an oil feedstock using the alkali metal (e.g., a strong agent) without the practitioner being required to handle, store, or transport the alkali metal.

Referring now to FIG. 1, a device 2 is illustrated that may be used to de-acidify a quantity of a first oil feedstock 9. As shown in FIG. 1, the oil feedstock 9 is a liquid that is placed within a chamber 3. The chamber 3 may be a reaction vessel, a chamber of an electrolysis cell (as will be described herein), etc. Those skilled in the art will appreciate what vessels, containers, etc., may be used as the chamber 3.

The oil feedstock 9 comprises a quantity of naphthenic acids 8. As described above, naphthenic acids 8 comprise carboxylic acids present in petroleum crude or various refinery streams. Naphthenic acids 8 are a mixture of many different compounds and cannot be separated out via distillation. In order to eliminate the naphthenic acids 8 from the oil feedstock 9, a quantity of an alkali metal 5 is added to the chamber 3. (The alkali metal is abbreviated as "AM.") In some embodiments, the alkali metal may be sodium, lithium or alloys of sodium and lithium. The chamber 3 may be kept at a temperature that is above the melting point of the alkali metal 5 such that the liquid alkali metal 5 may easily be added to the liquid oil feedstock. In some embodiments, the reaction occurs at a temperature that is above the melting point of the alkali metal (or above a temperature of about 100° C.). In other embodiments, the temperature of the reaction is less than about 450° C.

When added to the chamber 3, the alkali metal 5 may react with the oil feedstock 9. More specifically, the alkali metal 5 reacts with the quantity of the naphthenic acids 8 to form a de-acidified feedstock 12. As inorganic acid products 13 may also be formed from this reaction, a product separator 10 may be used to separate the de-acidified oil feedstock 12 from the inorganic acid products. Those skilled in the art will appreciate how this separation may occur. Moreover, those skilled in the art will appreciate the structures (such as a settling chamber, etc.) that may be used as the product separator 10. The product separator 10 may be integral with the chamber 3 or may be a separate structure, as shown in FIG. 1.

As explained herein, the reaction between the alkali metal 5 and the naphthenic acids 8 operates to eliminate the naphthenic acids 8 from the oil feedstock 9. Thus, the TAN value of the de-acidified oil feedstock 12 will be lower than the TAN value of the original (unreacted) first oil feedstock 9. For example, in some embodiments, the TAN value of the original (unreacted) oil feedstock 9 may be greater than or equal to 1 (such as, for example, 3, 4, 5, etc.) whereas the TAN value of the de-acidified oil feedstock 12 is a lower value, such as less than or equal to 1. As noted above, other acids in the oil feedstock 9 may contribute to the TAN value of the feedstock 9. These acids may also react with the alkali metal in a similar manner, further reducing the TAN value.

This reduction in TAN value may provide a significant financial benefit to the owner of the oil feedstock. As noted above, prices per barrel of oil products that are considered to be high TAN (e.g., with a TAN value greater than 1) are often discounted significantly with respect to barrels of oil products that are low TAN. Thus, by reducing the TAN value in the oil feedstock, the value of the oil feedstock may be significantly increased.

Figure 2:
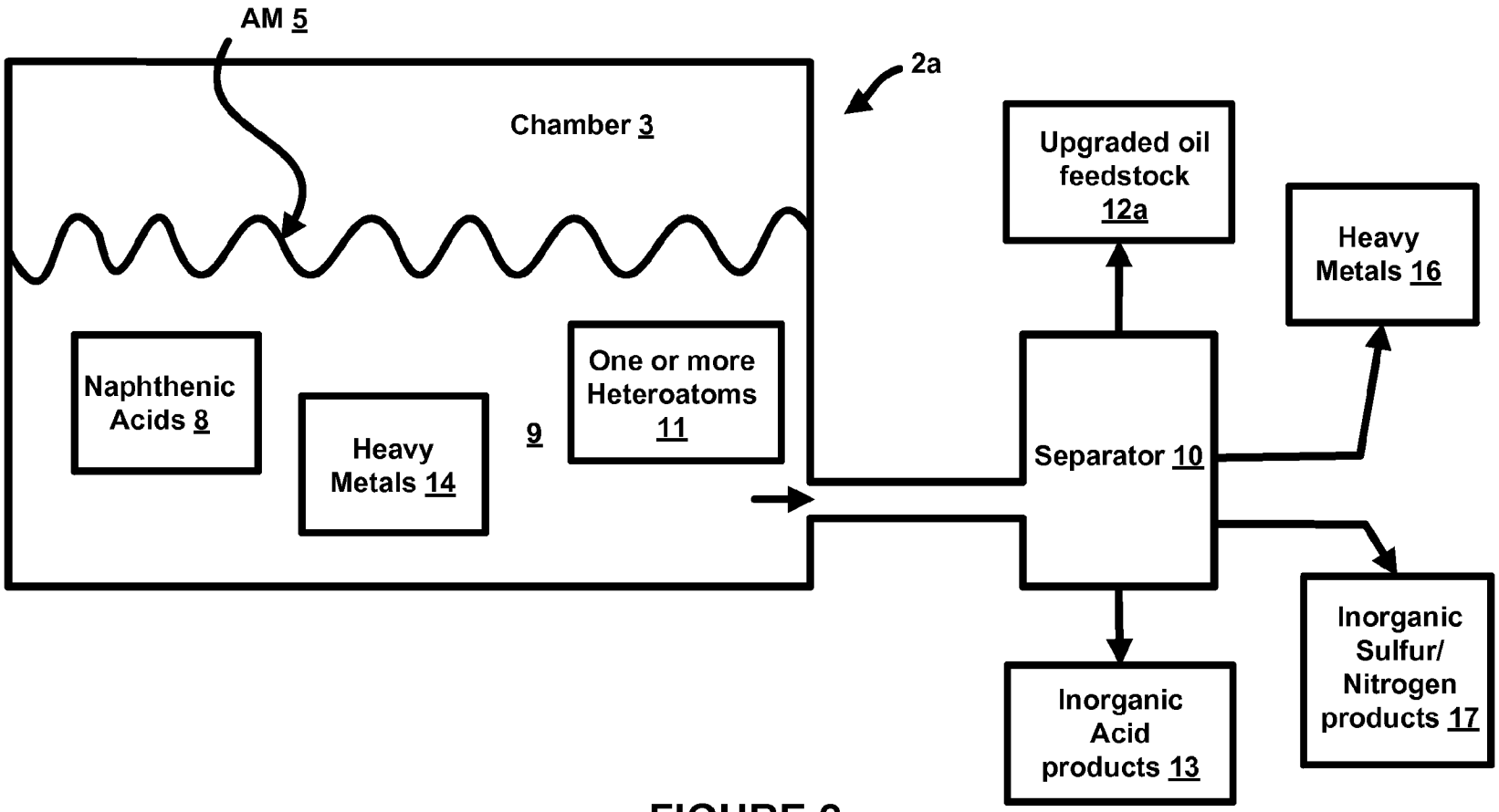
FIG. 2 shows a schematic drawing of a device that may be used to upgrade a quantity of an oil feedstock.

Referring now to FIG. 2, another embodiment of the device **2*a* is illustrated. As noted above, the device 2*a* is similar to the device 2 shown in FIG. 1. The device 2*a* may be designed to de-acidify the oil feedstock 9. At the same time, the device 2*a* may also be designed to further upgrade the first oil feedstock 9 by removing heavy metals 14 and/or one or more heteroatoms 11 that are present in the oil feedstock 9**.

As described above, heavy metals 14 (such as nickel, vanadium, iron, arsenic, etc.) are often found in samples of oil feedstock materials 9. In some embodiments, it may be desirable to remove these heavy metals 14, as such metals can poison catalysts that are typically utilized in hydrocarbon processing. However, as shown in FIG. 2, the device **2*a* may be designed such that the alkali metal 5 may react with the heavy metals 14 in the oil feedstock 9. More specifically, in addition to the alkali metal 5 reacting with the naphthenic acids 8 to de-acidify the feedstock (as described above), the quantity of the alkali metal 5 may further react with the heavy metals 14, thereby reducing the heavy metals into their metallic states. This reaction may also occur in the chamber 3**.

As shown in FIG. 2, these heavy metals 16 may then be separated and recovered (using the product separator 10). It should be noted that the heavy metals 16, in their metallic state, are inorganic materials and thus may separate out from the organic oil feedstock materials. Accordingly, the product separator 10 may use this property as a means of separating out the heavy metals 16. Those skilled in the art will appreciate that other separation techniques may also be used to separate out the heavy metals 16. Once the metals 16 have been separated, they may be recovered, sold, used in further processing, etc. As these metals are generally expensive commodities, the fact that such metals may be collected (and used/sold) may provide a significant commercial advantage for the owner of the feedstock.

In addition to removing heavy metals, the alkali metal 5 may also react with one or more heteroatoms 11 (such as N, S) that are present in the oil feedstock 9. These N, S atoms may be bonded to the carbon/hydrogen atoms in the organic oil feedstock 9. However, as noted herein, the alkali metal 5 may react with these one or more heteroatoms 11 to form inorganic sulfur/nitrogen products 17. For example, if the alkali metal 5 is sodium, then the reaction with the heteroatoms 11 forms inorganic sulfur/nitrogen products 17 such as $Na_2S$, $Na_3N$ and/or other inorganic products. (Again, a product separator 10 may be used to separate out the inorganic sulfur/nitrogen products 17 from the oil feedstock). Once the inorganic sulfur/nitrogen products 17 have been removed, the heteroatom to carbon ratio of the resulting oil feedstock is less than the heteroatom to carbon ratio of the original (unreacted) oil feedstock 9.

It should be noted that after the oil feedstock 9 has been de-acidified, demetalized, de-sulfurized and/or de-nitrogenized, then this oil feedstock is referred to as an "upgraded" oil feedstock **12*a*** in that this material is better suited for further refining, commercialization, etc.

It should be noted that in the embodiment shown in FIG. 2, a single product separator 10 is shown as separating out the heavy metals 16, the inorganic acid products 13 and the inorganic sulfur/nitrogen products 17, thereby removing these materials from the upgraded oil feedstock 12*a*. However, those skilled in the art will appreciate that multiple product separators 10 and/or separation techniques may be used to accomplish such separations. Further, there also may be a sequential separation of the various materials from the upgraded oil feedstock 12*a*.

Likewise, it should be noted that in the embodiment of FIG. 2, a single chamber 3 is used to react the oil feedstock 9 with the alkali metal 5 (and thus remove the naphthenic acids 8, heavy metals 14 and heteroatoms 11 from the organic feedstock). Those skilled in the art will appreciate that such reactions could also occur in different chambers. In other words, embodiments may be designed in which a first chamber is used to react the alkali metal 5 with the heavy metals 14 (and the heavy metals 14 are subsequently separated out), a second chamber is used to react the alkali metal 5 with the naphthenic acid 8 (and the acid products 13 are subsequently separated out) and then a third chamber used to react the alkali metal 5 with the heteroatoms 11 (and the sulfur/nitrogen products 17 are subsequently separated out). Of course, if different chambers were used for each of these reactions, the reaction conditions such as pressure, temperature, flow rates, etc., could be adjusted/tailored to optimize each specific reaction.

In the embodiments shown in FIGS. 1 and 2, the alkali metal 5 is shown being added to the chamber 3. Those skilled in the art will appreciate that there are a variety of different ways by which the alkali metal 5 may be added in order to induce a reaction. For example, a sample of the alkali metal 5 may simply be added to the chamber 3. However, many in the oil processing industry are uncomfortable handling metallic sodium (or other metallic alkali metals) because of their reactive nature. Thus, other embodiments may be designed in which the alkali metal 5 is formed in situ within the chamber 3 from alkali metals ions. In other words, alkali metal ions are added to the chamber 3 (which are safe and easy to handle) and then such ions are reduced back to the metallic state via an electrochemical reduction reaction. Once these alkali metal ions have been reduced in situ to form the metallic alkali metal 5, these formed alkali metals 5 immediately react with the oil feedstock 9 (in the manner outlined herein) and are thus consumed almost instantaneously after formation. The embodiments that electrochemically form the alkali metal in situ can be advantageous in that they provide the strong reducing power and reactivity of alkali metal to the oil feedstock without ever having an appreciable amount of the metal present.

Figure 3:
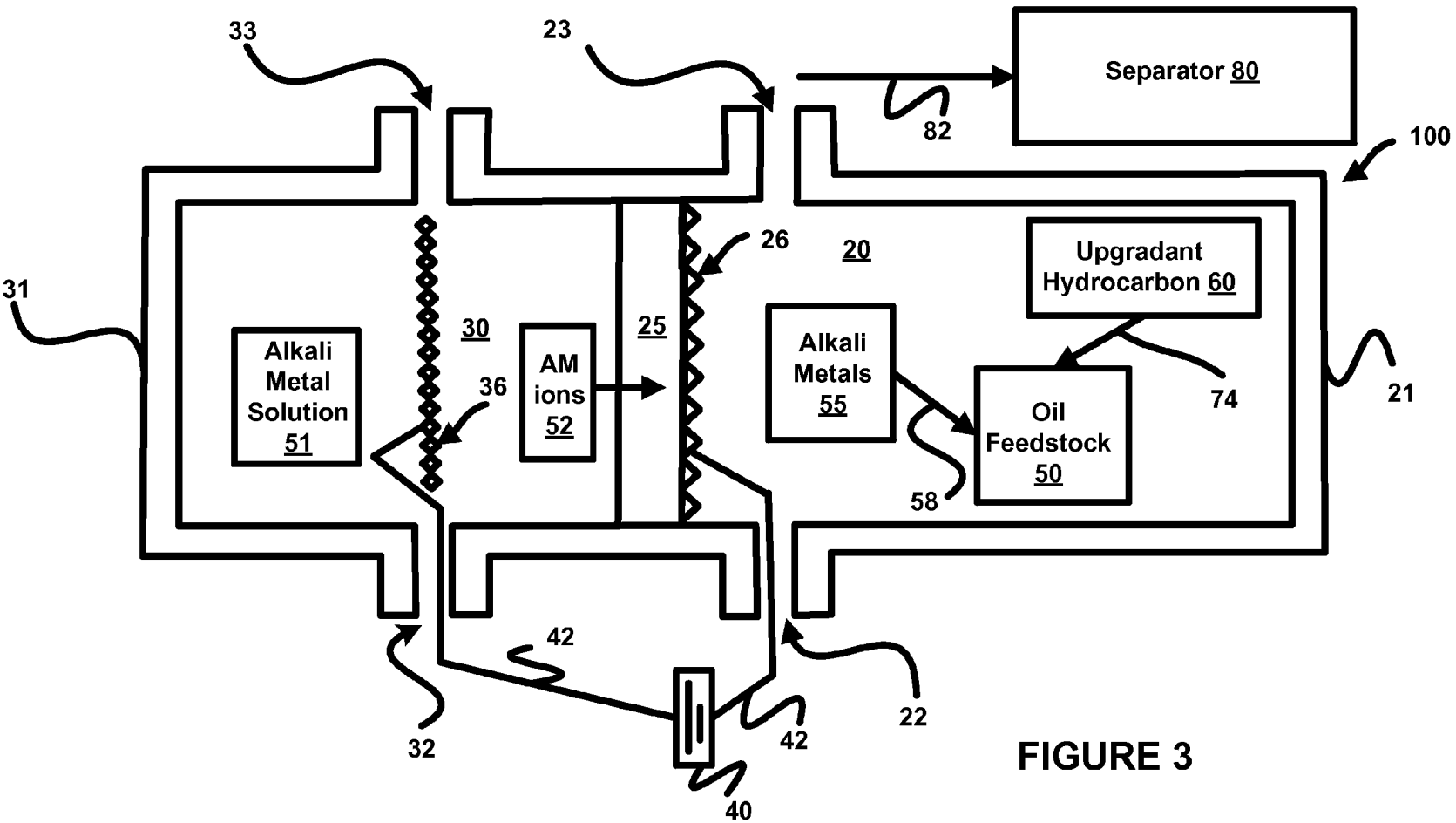
FIG. 3 shows a schematic drawing of a device that may be used to de-acidify a quantity of an oil feedstock.

Referring now to FIG. 3, an embodiment of a device 100 that may be used to de-acidify oil feedstocks, as well as remove the heteroatoms/heavy metals and/or upgrade the feedstock is illustrated. Specifically, the device 100 consists of at least two chambers, namely a feedstock chamber 20 and an alkali metal source chamber 30. The feedstock chamber 20 has an outer wall 21 and may have an inlet 22 and outlet 23.

The feedstock chamber 20 may be separated from the alkali metal source chamber 30 by an alkali metal ion conductive separator 25. The ion separator 25 may be comprised of ceramic materials generally known as Nasicon, sodium beta alumina, sodium beta prime alumina or sodium ion conductive glass if the alkali metal is sodium; or Lisicon, lithium beta alumina, lithium beta prime alumina or lithium ion conductive glass if the alkali metal is lithium. The materials used to construct the ion separator 25 are commercially available from Ceramatec, Inc., of Salt Lake City, Utah.

A cathode 26 which is negatively charged and connected to a power source 40 (via wires 42) may be, at least partially, housed within the feedstock chamber 20. Preferably the cathode 26 is located in close proximity to the ion separator 25 to minimize ionic resistance. The cathode 26 may be contacting the ion separator 25 (as shown in FIG. 3) or screen printed on the ion separator 25. In other embodiments, the cathode 26 may be integrated with the ion separator 25 as disclosed in U.S. Patent Publication 2010/0297537 entitled "ELECTROCHEMICAL CELL COMPRISING IONICALLY CONDUCTIVE MEMBRANE AND POROUS MULTIPHASE ELECTRODE" (which patent application is expressly incorporated herein by reference.) By placing the cathode 26 on or near the ion separator 25, the oil feedstock does not necessarily have to be ionically conducting in order to transfer ions/charges.

The alkali metal source chamber 30 has an outer wall 31 and may have an inlet 32 and outlet 33. An anode 36 (which is positively charged) and connected to the power source 40 (via wires 42) may be, at least partially, housed within the source chamber 30. Suitable materials for the cathode 26 include materials comprising, carbon, graphite, nickel, iron which are electronically conductive. Suitable materials for the anode 36 include materials comprising titanium, platinized titanium, carbon, graphite. In the embodiment shown in FIG. 3, the cathode 26 and the anode 36 are connected to the same power supply 40. Further, FIG. 3 shows the wires 42 exiting the chambers 20, 30 via inlets 22, 32. Such depictions are made for clarity and are not limiting. Those skilled in the art will appreciate how the power source 40/wires 42 may be otherwise arranged in order to connect to the cathode 26 and/or the anode 36. Likewise, those skilled in the art will appreciate that the cathode 26 and the anode 36 may be connected to power supplies in various manners, etc.

A mode of operation for the device 100 will now be described. Specifically, a first oil feedstock 50 may enter the feedstock chamber 20 (such as, for example, by flowing through the inlet 22). Concurrently, a dissolved solution of alkali metals 51 will flow through the alkali metal source chamber 30. This solution of alkali metals may be, for example, a solution of sodium sulfide, lithium sulfide, sodium chloride, sodium hydroxide, etc. A voltage is then applied to the anode 36 and cathode 26 from the source 40. This voltage causes chemical reactions to occur. These reactions cause alkali metal ions 52 (abbreviated "AM ions" 52") to pass through the ion separator 25. In other words, the alkali metal ions 52 flow from the alkali metal source chamber 30, through the ion separator 25, into the feedstock chamber 20.

Once the alkali metal ions 52 (such as, for example, sodium ions or lithium ions) pass through the ion separator 25, the ions 52 are reduced to the alkali metal state 55 (e.g., into sodium metal or lithium metal) at the cathode 26. Once formed, the alkali metal 55 intermixes with the feedstock 50 (as shown by arrow 58). As described herein, the reaction between the oil feedstock 50 and the alkali metal 55 may involve a reaction between the acids (such as naphthenic acid) in the oil feedstock 50. Thus, the reaction with the alkali metal 55, which was formed in situ within the chamber 20, operates to reduce the acid content in the oil feedstock 50, thereby reducing the TAN value of the oil feedstock 50.

Additionally and/or alternatively, the reaction between the oil feedstock 50 and the alkali metal 55 formed within the chamber 20 may cause a reaction with the sulfur or nitrogen moieties within the oil feedstock 50. This reaction may also reduce heavy metals, such as vanadium and nickel in the feedstock 50. Further, as explained in the '874 application, at an elevated temperature and elevated pressure, the reaction between alkali metals 55 and the heteroatoms (S, N) forces the sulfur and nitrogen heteroatoms to be reduced by the alkali metals into ionic salts (such as $Na_2S$, $Na_3N$, $Li_2S$, etc.). These ionic salts may then be removed from the oil feedstock 50. As such, the content of sulfur and nitrogen within the oil feedstock 50 may be significantly reduced by the reaction of the alkali metal 55 formed within the chamber 20. In other words, the heteroatom-to-carbon ratio of the upgraded oil feedstock may be less than the heteroatom-to-carbon ratio of the original (unreacted) oil feedstock. Also, the amount of heavy metals in the feedstock may further be reduced. Thus, the ratio of carbon to heavy metals in the upgraded (reacted) feedstock is less than the ratio of carbon to heavy metals in the original (unreacted) feedstock.

Further, in addition to the oil feedstock 50, the chamber 20 may also include a quantity of an upgradant hydrocarbon 60 that reacts with the oil feedstock 50 (as shown by arrow 74). Specifically, as taught by the '874 application, when the sulfur/nitrogen moieties of the oil feedstock 50 react with the alkali metals 55, radical species are formed that may react with the upgradant hydrocarbon 60. In some embodiments, the upgradant hydrocarbon 60 may be hydrogen gas, including the hydrogen gas formed by the reaction with naphthenic acid. (It should be noted that if hydrogen is used as the hydrocarbon 60, the amount of hydrogen needed is less than the amount of hydrogen that would be required if a typical hydrotreatment process were utilized). In other embodiments, the upgradant hydrocarbon 60 comprises natural gas, shale gas and/or mixtures thereof, methane, ethane, propane, butane, pentane, their isomers, ethene, propene, butene, pentene, dienes, and/or mixtures thereof. As explained in the '874 application, this reaction with the upgradant hydrocarbon 60 may operate to produce an upgraded hydrocarbon that has a greater hydrogen-to-carbon ratio than the original oil feedstock 60. The upgraded oil feedstock produced in the reaction may also have a greater energy value than the original oil feedstock 60. Typically the presence of upgradant hydrocarbon 60 may result in a reduction of formation of insoluble solids during the reaction. It is believed that these solids are large organic polymers that are formed as part of the radical reactions. However, by using the upgradant hydrocarbon 60, this hydrocarbon 60 acts as a "capping" species that prevents the formation of these solid, organic polymers. Thus, by using the hydrocarbon 60, the subsequent yield of the liquid oil feedstock (e.g., the desired product) may be increased.

The reactions described in FIG. 3 may be conducted at elevated temperatures. For example, the reactions may occur at temperatures above the melting temperature of sodium or at higher temperatures found effective for the particular feedstock. The mode of operation of the device 100 may further consist of using molten sodium as the sodium source 51 in the alkali metal source chamber 30 or lithium metal as the lithium source. The reactions may further be conducted at elevated pressure, for example in the 300-2000 pounds per square inch range.

In some embodiments, the oil feedstock 50 may be passed through the device 100 (as the solution of sodium sulfide also passed through). Once passed through the device 100, the oil feedstock may flow into another vessel operated at a different temperature and pressure (e.g., temperatures and pressures more conducive to the reactions desired and where the residence time of the feedstock in the second vessel size is matched to the reaction kinetics and flow rates).

As described herein, various solids, inorganic compounds, etc., may be formed when performing the reactions outlined herein. These inorganic products may comprise $Na_2S$, $NaN_3$, heavy metals and solid organic polymers that are formed by the radical reactions. In order to deal with these inorganic compounds, the process used in conjunction with the device of FIG. 3 may further involve filtering, or separating by centrifugal forces the feedstock after it has been exposed to the sodium for sufficient time to remove solids from the liquids. This separation may involve the use of a separator 80, as described below.

The oil feedstock 50, alkali metal solution 51 and other components of the device 100 may be dissolved in a polar solvent such as Formamide, Methyl formamide, Dimethyl formamide, Acetamide, Methyl acetamide, Dimethyl acetamide, Triethylamine, Diethyl acetamide, Ethylene glycol, Diethylene glycol, Triethylene glycol, Tetraethylene glycol, Ethylene Carbonate, Propylene Carbonate, Dimethylpropyleneurea, Butylene Carbonate, Cyclohexanol, 1,3-Cyclohexanediol, 1,2 Ethanediol, 1,2-Propanediol, Ethanolamine, Methyl sulfoxide, Dimethyl sulfoxide, Tetramethylene sulfoxide, Sulfolane, Gamma-butyrolactone, Nitrobenzene, Acetonitrile, Pyridine, quinoline, ammonia, ionic liquids or molten fused salts. For example, the alkali metal solution 51 may be dissolved in one or more of these solvents and then be allowed to flow into the alkali metal source chamber 30. (The salts that are used for the alkali metal solution 51 may be alkali metal chlorides, hydroxides, phosphates, carbonates, sulfides and the like.) Similarly, such solvents may be used with the oil feedstock 50 and/or the hydrocarbon 60 and then the mixture may be allowed to flow into the chamber 20.

Depending on the alkali metal source (e.g., the alkali metal solution 51), the anode reaction in the alkali metal source chamber 30 may vary. For example sulfides may form polysulfides and or elemental sulfur, chlorides may form chlorine gas, hydroxides may form oxygen gas, carbonates may form oxygen gas and evolve carbon dioxide and the like. If the alkali metal source is an alkali metal, metal ions will simply form. These variations constitute different embodiments. Gas handling and recovery may be a part of the overall process.

As shown in FIG. 3, the products formed in the oil feedstock chamber 20 may be sent to a product separator 80 (as shown by arrow 82). In this product separator 80, the inorganic products may form a phase that is separable from an organic phase that comprises the upgraded oil feedstock and/or unreacted oil feedstock. To facilitate this separation, a flux may be added to the product separator. (Those skilled in the art are familiar with the materials that may be used as the flux that will facilitate separation between the organic feedstock materials and the inorganic products.) After separation, the alkali metal from the inorganic products may be regenerated and reused. In some embodiments, the product separator 80 may be a settling chamber or other similar structure.

Figure 4:
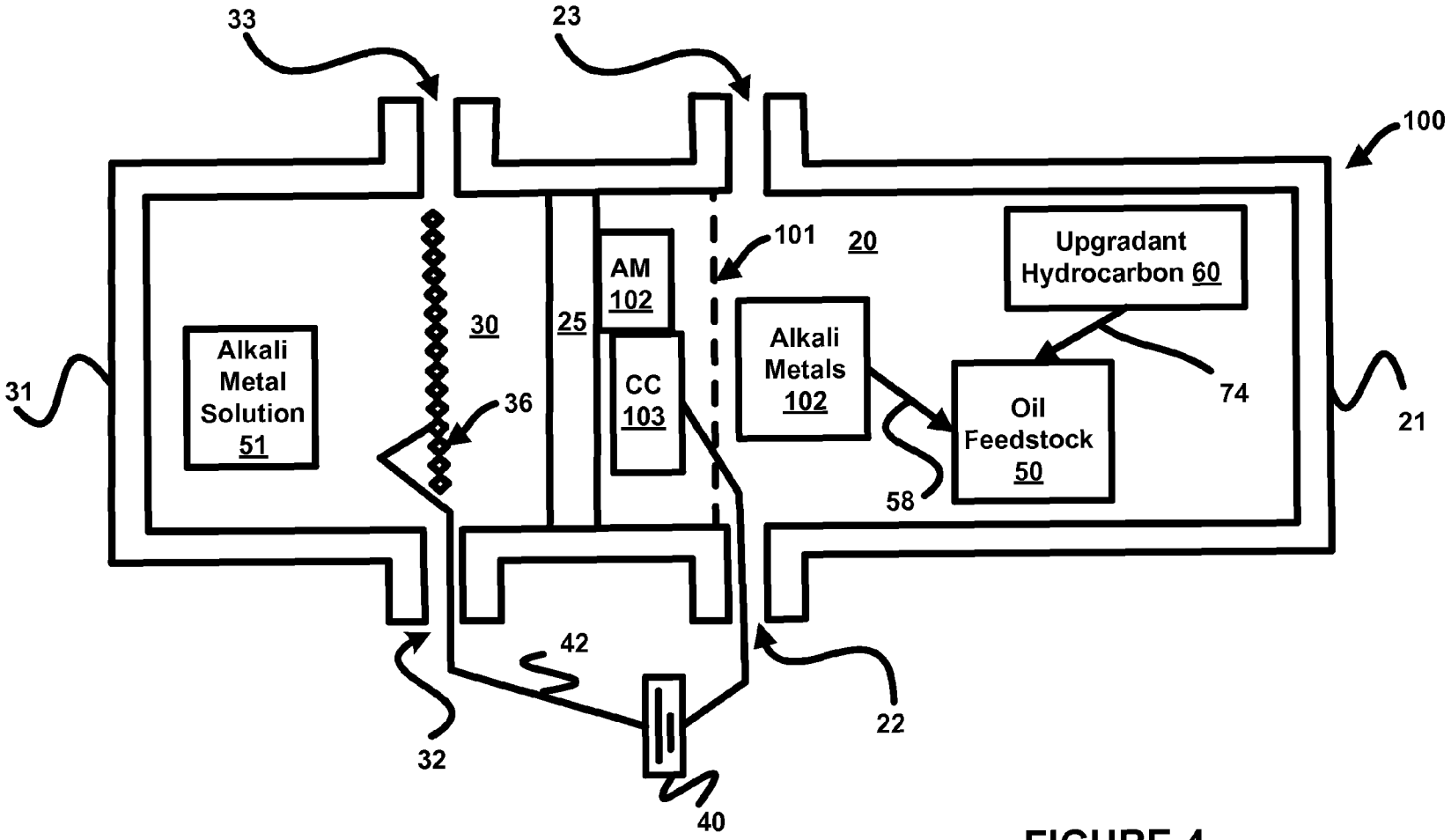
FIG. 4 shows a schematic drawing of another embodiment of a device that may be used to de-acidify a quantity of an oil feedstock.

FIG. 4 is a schematic that includes another embodiment of the device 100. Much of the structures/elements depicted in FIG. 4 are similar to that which was described in FIG. 3. Accordingly, for purposes of brevity, the discussion of many of these structures/elements is omitted.

FIG. 4 depicts a schematic embodiment similar to the depiction in FIG. 3 except a porous partition 101 resides between the ion separator 25 and the feedstock 50. This partition 101 may be a metal mesh or perforated metal sheet, or glass fiber mesh, carbon fiber mesh or other material with holes or pores that will allow alkali metal to flow through. Alkali metal 102 is formed at the ion separator 25 and may serve as the cathode with a negatively charged current collector 103 in contact with the alkali metal 102. (Alternatively, the porous partition 101, if electronically conductive, may be negatively charged and serve as the current collector.) Once the alkali metal 102 is formed, it may flow through the porous partition 101 and may then react with the oil feedstock 50 in the manner described above.

Thus, as indicated herein, there are at least three different processes as part of this invention for de-acidifying these streams:

1) Add sodium or lithium directly to the stream to form the acid salt and hydrogen, then filter out the acid salts from the stream;
2) Use the novel device in a mode where a sodium or lithium source in alkali metal source chamber and the feedstock is in the feedstock chamber, and where sodium metal forms at the cathode located with the feedstock chamber, where the alkali metal reacts with the feedstock to convert the acids to the sodium or lithium salt of the acid and hydrogen evolves as a byproduct;
3) Use the novel device in a mode where a sodium or lithium source in alkali metal source chamber and the feedstock is in the feedstock chamber, and where alkali ions transport across the ion separator dividing the two chambers under a potential gradient, and hydrogen evolves at the cathode located with the feedstock chamber, where the alkali metal ions combine with the organic acid anions to form a salt, in this case using a cathode material with low hydrogen overpotential (such as platinum or other materials) may be preferred.

In the case of acid removal, there may not be any reason to add an upgradant hydrocarbon (gas) 60 to the feedstock chamber with the cathode since hydrogen gas may be a byproduct. As such, this formed hydrogen may act as the upgradant hydrocarbon 60. If heteroatoms such as sulfur, or nitrogen are present, an upgradent gas 60 such as hydrogen, natural gas, shale gas and/or mixtures thereof, may be needed.

It should also be noted that the addition of the alkali metal 102 may not simply neutralize the acidic hydrogen in the naphthenic acid. Specifically, naphthenic acid has the structure: R—COOH. In some embodiments, the alkali metal 102 may react with the oxygen atoms (in addition to the hydrogen atoms) such that the remaining hydrocarbon after the alkali metal addition has the structure R—$CH_3$, R—H, etc. (The reason for this is that the alkali metal 102 may also reduce the oxygen moiety as well as the hydrogen moiety.) The formed inorganic products may thus include NaOH, $Na_2O$, etc. As noted above, after reaction with the alkali metal 103, the TAN value of the feedstock 50 is reduced. However, given the above-recited reactions with the oxygen moieties, the TAN value may not be increased (or returned to its original state) by simply reacting the de-acidified oil feedstock with base (such as NaOH). Rather, as described herein, the reduction of the TAN value may also operate to convert the naphthenic or other acid groups into pure hydrocarbon functional groups (such as is R—$CH_3$, R—H, etc.).

Figure 5:
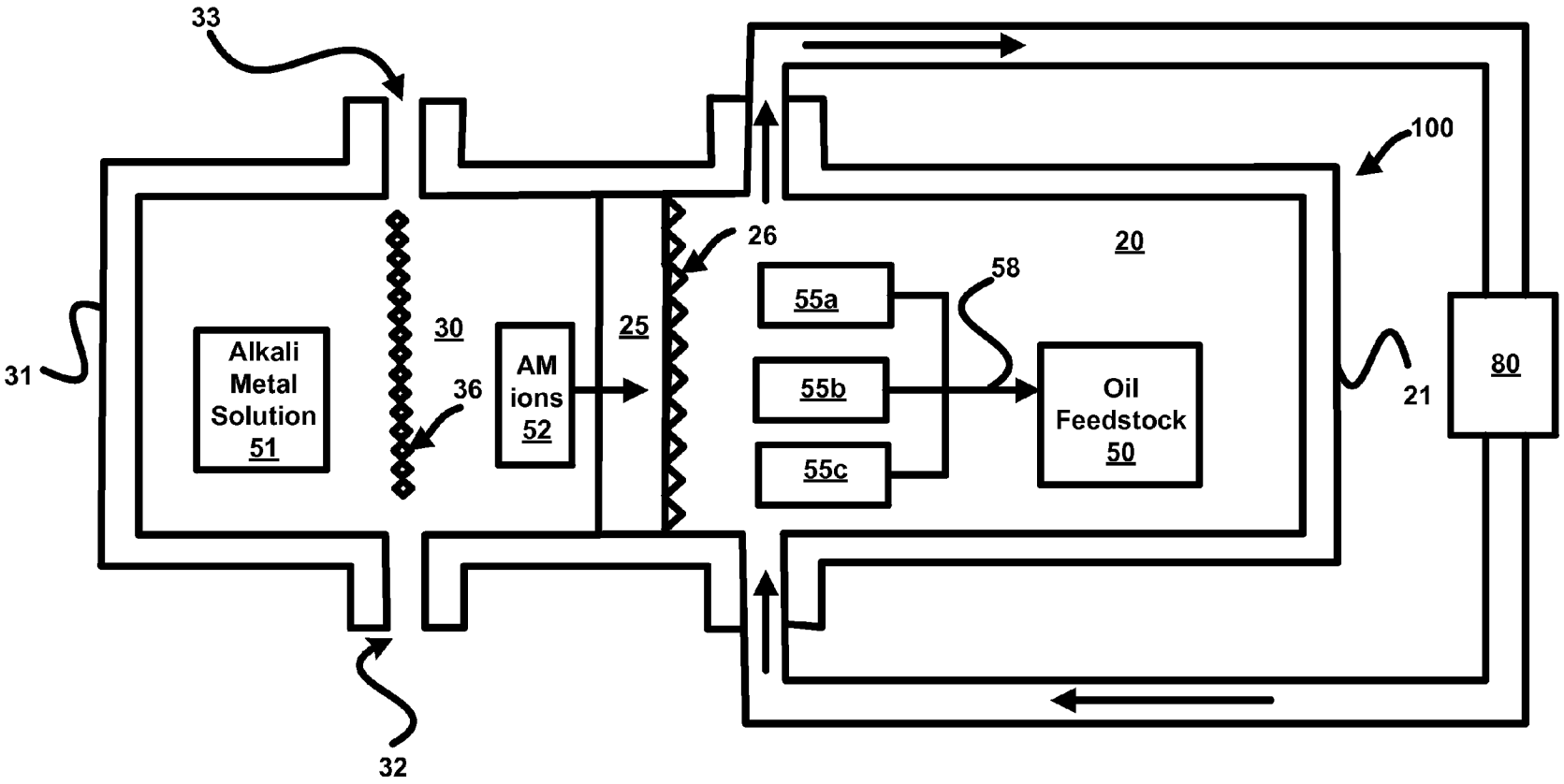
FIG. 5 shows a schematic drawing of another embodiment of a device that may be used to upgrade a quantity of an oil feedstock.

Referring now to FIG. 5, another embodiment of a device 100 is illustrated. Specifically, the device 100 may be used to upgrade an oil feedstock 50. More specifically, the feedstock 50 may be upgraded by having the feedstock 50 be de-acidified, desulfurized, demetalized and denitrogenized. In other words, the device 100 is operable to remove sulfur, heavy metals, acids (such as naphthenic acid) and nitrogen from the oil feedstock 50.

The embodiment of the device 100 that is shown in FIG. 5 is similar to that which is shown and described in FIG. 3. For purposes of brevity, much of this discussion will be omitted. However, for clarity, the wires 42 and the power source 40 are not shown in FIG. 5. However, those skilled in the art will appreciate that such structures are indeed present and may be necessary in order to conduct the electrolytic reactions associated with the device 100.

As described herein, the oil feedstock 50 shown in FIG. 5 may include quantities of heavy metals, naphthenic acid and at least one heteroatom (e.g., nitrogen and sulfur). Accordingly, such materials may be removed from the oil feedstock 50 using the methods outlined herein. Specifically, the oil feedstock 50 is contacted with quantities of alkali metals 55*a*, 55*b*, 55*c*. (The arrows 58 are designed to represent the reactions between the alkali metals 55*a*, 55*b*, 55*c* and the oil feedstock 50.) More specifically, the feedstock 50 may be contacted with a first quantity of an alkali metal 55*a*. The reaction between the first quantity of the alkali metal 55*a* and the feedstock 50 is such that the alkali metal 55*a* reacts with the heavy metals that are in the feedstock 50. This reacted feedstock may then exit the chamber 20 and may pass through a product separator 80. The purpose of the product separator 80 is to remove the heavy metals from the oil feedstock. These heavy metals may then be recovered, sold, etc.

As shown by FIG. 5, after passing through the product separator 80, the feedstock 50 (minus the heavy metals which were previously removed) may be brought back into the chamber 20. This chamber 20 may be the same chamber that was previously used to remove the heavy metals, or it may be a chamber 20 of a different device 100 that is positioned downstream from the product separator 80.

Once in the chamber 20, the oil feedstock 50 (which has had the heavy metals removed) may then be reacted with a second quantity of the alkali metal 55*b*. This time, the alkali metal 55*b* reacts with the naphthenic acid to form a de-acidified oil feedstock, wherein a TAN value of the unreacted oil feedstock is less than a TAN value of the de-acidified oil feedstock. Again, after the acids have been reacted, the reacted oil feedstock 50 may be sent to the product separator 80 which may operate to remove the inorganic materials that were formed during the reaction with the second quantity of alkali metals 55*b*. This separation of inorganic materials may occur within the same product separator 80 that was used to remove the heavy metals or may be conducted in a different separator product 80.

After passing through the product separator 80, the feedstock 50 (minus the heavy metals and the naphthenic acids which were previously removed) may be brought back into the chamber 20. This chamber 20 may be the same chamber that was previously used to remove the heavy metals/naphthenic acids, or it may be a chamber 20 of a different device 100 that is positioned downstream from the product separator 80. Once in the chamber 20, the oil feedstock 50 (which has had the heavy metals/naphthenic acids removed) may then be reacted with a third quantity of the alkali metal 55*c*. This reaction with the third quantity of the alkali metal 55*c* removes at least one heteroatom (e.g., N, S) from the feedstock 50 to form an upgraded oil feedstock. The heteroatom to carbon ratio of the upgraded oil feedstock is less than a heteroatom to carbon ratio of the oil feedstock. Once again, this product may then pass through a product separator 80 to remove the inorganic materials and/or N, S moieties from the oil feedstock, thereby resulting in an upgraded oil feedstock.

It should be noted that the alkali metal quantities 55*a*, 55*b*, 55*c* in FIG. 5 were introduced using the method of the device 100—e.g., by having alkali metal ions pass through the ion separator 25 and then be reduced to the metallic state in situ within the chamber 20. Of course, other embodiments may be designed in which one or more of the alkali metal quantities 55*a*, 55*b*, 55*c* are introduced directly into the oil feedstock 50 (e.g., without having the metal be formed via a reduction reaction). The different quantities of the alkali metals 55*a*, 55*b*, 55*c* may be the same alkali metal or may be different alkali metals.

Figure 6:
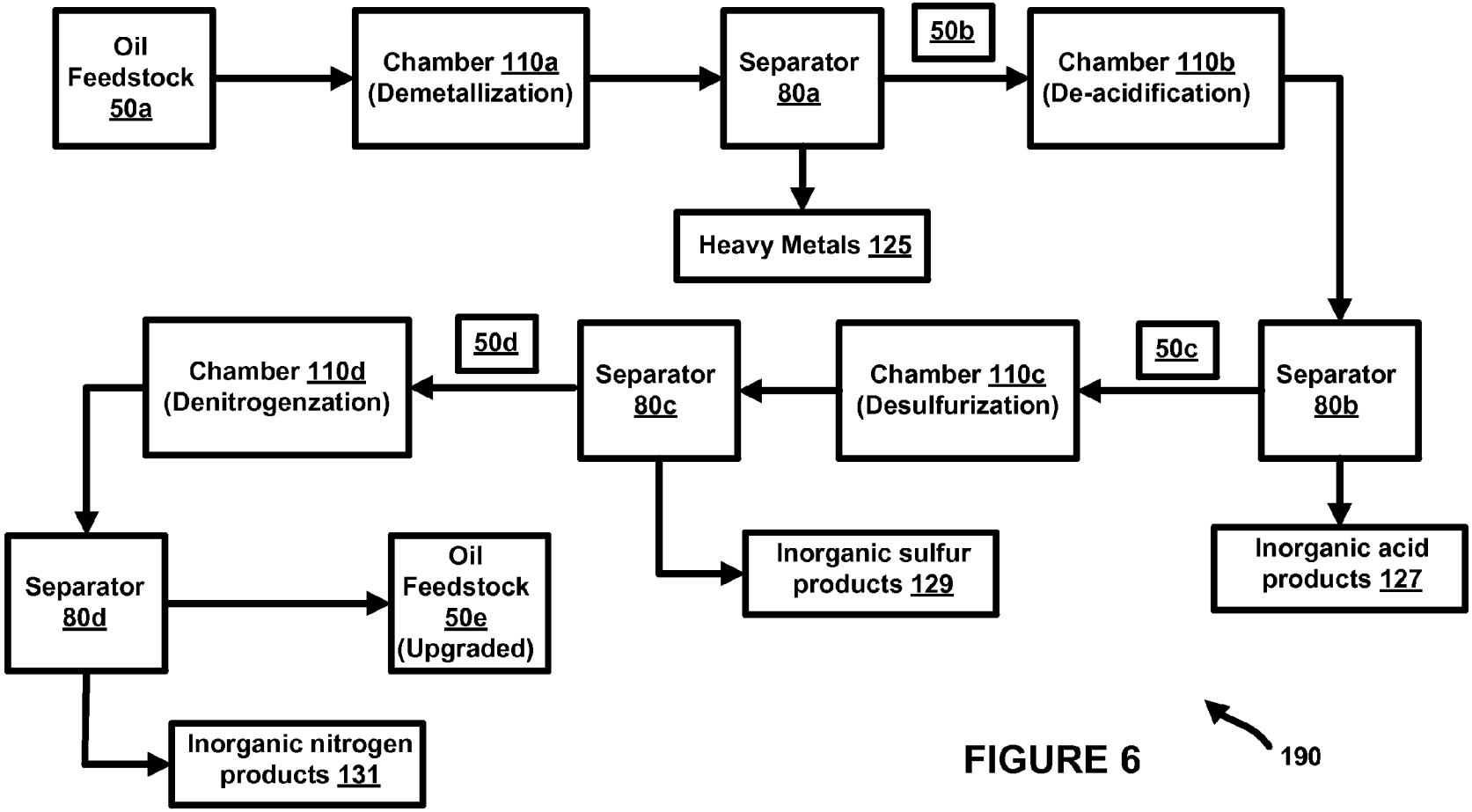
FIG. 6 is a flow diagram of a method for upgrading a quantity of an oil feedstock.

Referring now to FIG. 6, a flow diagram of a method 190 that may be used to upgrade a quantity of a first oil feedstock 50*a* is shown. Specifically, the quantity of the oil feedstock 50 may be obtained. This oil feedstock 50 may include quantities of heavy metals, acids (such as napthenlic acid), and/or one or more heteroatoms (such as sulfur and nitrogen moieties). In order to upgrade the oil feedstock 50*a*, these metals/heteroatoms/acids may be removed from the oil feedstock 50*a*. Specifically, the quantity of the oil feedstock 50*a* may be added to a chamber 110*a*. This chamber 110*a* may be referred to as a "de-metalization" chamber in that the heavy metals are removed from the oil feedstock 50*a* in this chamber 110*a*. In some embodiments, the chamber 110*a* may be an oil feedstock chamber 20 of the type described above. However, in other embodiments, the chamber 110*a* may simply be another type of vessel that is designed to remove metals from the oil feedstock 50*a*. In order to remove the metals from the oil feedstock 50*a*, a quantity of alkali metals (such as alkali metals 55*a* shown in FIG. 5) may be added to the feedstock 50*a*. Once the reaction has occurred, the products may be placed within a product separator 80*a*. Those skilled in the art will appreciate the types of devices (such as a settling chamber) that may be used as the product separator 80*a*. In this product separator 80*a*, heavy metals 125 are separated out, leaving only a quantity of "de-metalized" oil feedstock 50*b*.

This oil feedstock 50*b* may then be added to a chamber 110*b*. The chamber 110*b* may be the same chamber as the chamber 110*a* (e.g., the oil feedstock material is re-inserted into the chamber 110*a*) or it may be a different vessel. The chamber 110*b* may be referred to as a "de-acidification" chamber in that the oil feedstock 50*b* may be de-acidified in this chamber 110*b*. In order to conduct this reaction, the oil feedstock 50*b* is reacted with a quantity of an alkali metal (such as second quantity of the alkali metal 55*b* shown in FIG. 5). This reaction with the alkali metal 55*b* reacts with the naphthenic acid in the feedstock 50*b*. More specifically, the alkali metal 55*b* eliminates the naphthenic acid such that the reacted oil feedstock has a TAN value that is less than the TAN value of the (unreacted) oil feedstock 50*a*.

Once the reaction has occurred, the products may be placed within a product separator 80*b*. Those skilled in the art will appreciate the types of devices (such as a settling chamber) that may be used as the product separator 80*b*. The product separator 80*b* may be the same structure as the product separator 80*a* or may be a different element. In this product separator 80*b*, inorganic acid products 127 are separated out, leaving only a quantity of "de-acidified" oil feedstock 50*c*.

This de-acidified oil feedstock 50*c* (which has also been de-metalized) may then be added to a chamber 110*c*. This chamber 110*c* may be the same as either or both of the chambers 110*a*, 110*b*, or in other embodiments, the chamber 110*c* may be a different chamber than the chambers 110*a*, 110*b*. This chamber 110*c* may be referred to as a "de-sulfurization" chamber in that sulfur moieties from the oil feedstock may be removed. More specifically, an alkali metal (such as a third quantity of the alkali metal 55*c*) may be added to react with the oil feedstock. More specifically, this reaction involves reacting the alkali metal with a heteroatom, such as sulfur. (This reaction is described above). Once reacted, the products may be added to a product separator 80*c* which operates to remove inorganic sulfur products 129 from the oil feedstock, thereby producing de-sulfurized feedstock 50*d*.

This feedstock 50*d* may further be added to a chamber 110*d*. This chamber 110*d* may be the same as or different than the chambers 110*a*, 110*b*, 110*c*. In this chamber, heteroatoms such as nitrogen are removed from the oil feedstock by reacting the feedstock with an alkali metal quantity (such as, for example, alkali metal 55*c* of FIG. 5). After this reaction has occurred, the inorganic nitrogen products 131 may be removed via product separator 80*d* (which may be the same as, or a different structure than, the product separators 80*a*, 80*b*, 80*c*). The resulting oil feedstock, after all of these products have been removed, may be classified as an "upgraded" oil feedstock 50*e*.

In the embodiment shown in FIG. 6, the reactions with the sulfur moieties and the nitrogen moieties (e.g., heteroatoms) are shown as different steps. Those skilled in the art will recognize that other embodiments may involve a single step (e.g., a single addition of a third quantity of an alkali metal) to eliminate all of the S and N heteroatoms. If the sulfur and nitrogen are eliminated together via a single addition of alkali metal, embodiments may be designed in which up to 80% of the sulfur may be removed from the oil feedstock before the nitrogen moieties begin to react with the alkali metal. It is also understood that depending on the actual operating conditions and nature of the feedstock, the order in which the various species are removed may differ from the order illustrated in FIG. 6.

Figure 7:
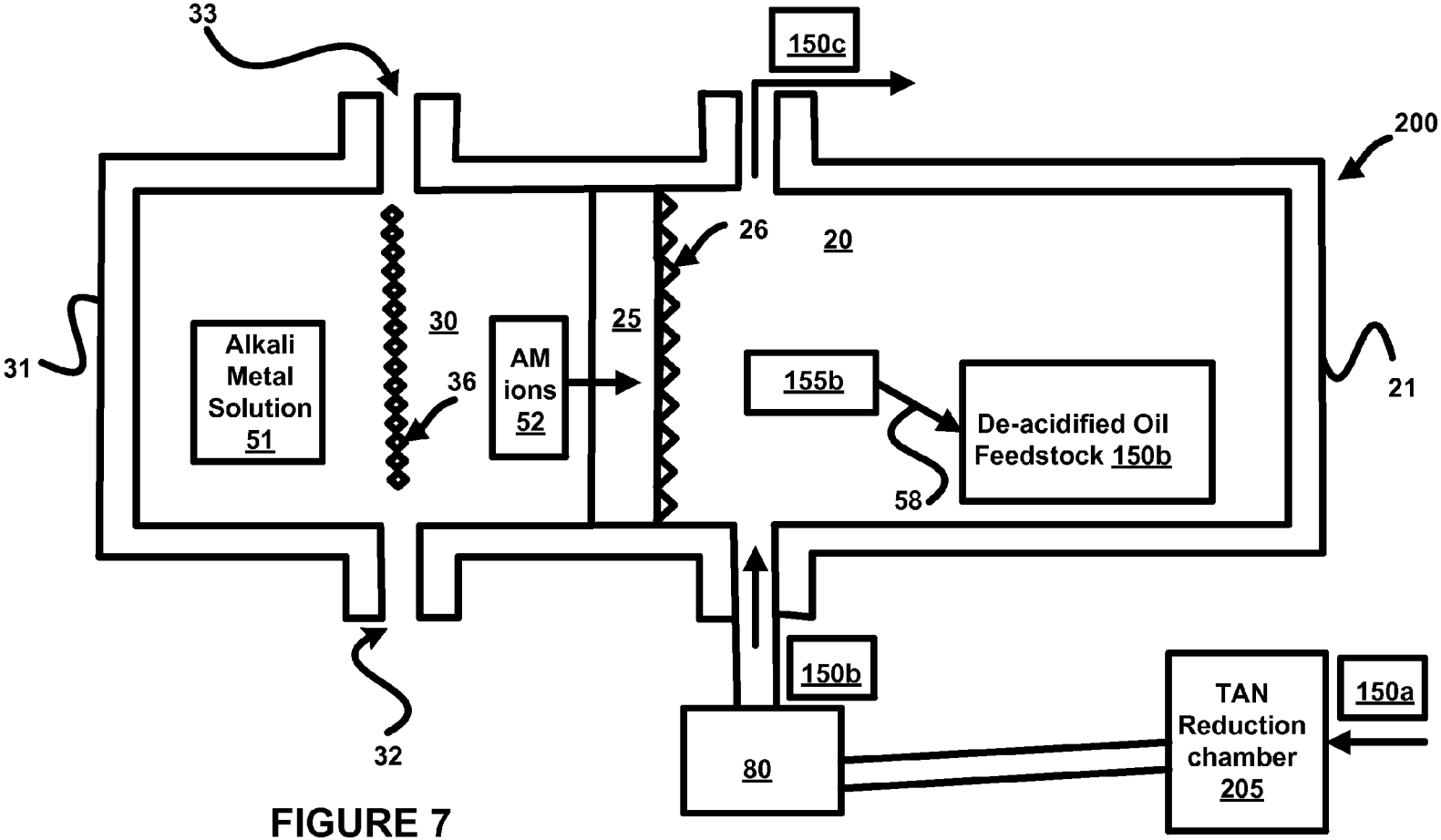
FIG. 7 a schematic drawing of another embodiment of a system that may be used to upgrade a quantity of an oil feedstock.

Referring now to FIG. 7, another embodiment of a system 200 for upgrading an oil feedstock is shown. It should be noted that the system 200 includes many of the same features that are associated with the device 100 of FIG. 3. For purposes of brevity, much of this discussion will be omitted. However, for clarity, the wires 42 and the power source 40 are not shown in FIG. 7. However, those skilled in the art will appreciate that such structures are indeed present and may be necessary in order to conduct the electrolytic reactions associated with the system 200.

In the embodiment of FIG. 7, a quantity of a first oil feedstock 150*a* is added to a TAN reduction chamber 205. This chamber 205 is a chamber into which an alkali metal (in its metallic form) may be added. This addition of the alkali metal to the feedstock 150*a* operates to eliminate naphthenic acid in the feedstock 150*a*. Accordingly, the TAN value of the feedstock 150*a* after it has been reacted in the TAN reduction vessel 205 is significantly reduced. A separator (which is not shown in FIG. 7) may be used to remove the formed inorganic materials from the feedstock. The feedstock leaving this chamber 205 may be referred to as de-acidified oil feedstock 150*b*.

The de-acidified feedstock 150*b* may be added to a chamber 20 so that it may be exposed to alkali metal 155*b*, thereby eliminating the heteroatoms and/or the heavy metals in the feedstock 150*b*. Thus, FIG. 7 shows an embodiment in which the chamber 205 used to reduce the TAN value is separate from the chamber 20 that is used to de-nitrogenize/de-sulfurize the feedstock. Thus, as shown by FIG. 7, the temperature and pressure and flow rate for optimal TAN reduction may be used in the TAN vessel 205, and then different temperatures/pressures/flow rates, etc. may be used in the chamber 20 for the other chemical reactions. These different temperatures/pressures/flow rates may be matched to the reaction kinetics of the specific reactions.

The embodiment shown in FIG. 7 illustrates that there is a significant amount of flexibility associated with the present embodiments. For example, as shown in FIG. 7, there may be a TAN reduction chamber 205 that is designed to reduce the TAN value of the oil feedstock. Once this TAN value has been reduced (for example to a value that is less than or equal to 1), then other processes may be used to eliminate the heteroatoms, heavy metals, etc. associated with the oil feedstock. Thus, the owner of the oil feedstock can design a system that will be appropriate for processing their particular sample of hydrocarbon material.

Once the heteroatoms/heavy metals have been removed by the chamber 20, the oil feedstock 150*c* may flow out of the chamber 20. This oil feedstock will be referred to as "upgraded" oil feedstock 150*c*.

Further, those skilled in the art will appreciate that the amount of alkali metal that is needed to reduce the TAN value below 1, to remove the heteroatoms, to react with the heavy metals, etc., will depend upon the particular sample of oil feedstock/hydrocarbon material. Accordingly, by performing testing on the sample oil feedstock, a skilled artisan can determine how much alkali metal may be needed to upgrade the oil feedstock.

All the patent applications and patents listed herein are expressly incorporated herein by reference.

What is claimed is:

1. A method of de-acidifying an oil feedstock comprising:
in a chamber reacting an oil feedstock with an alkali metal in its metallic state to form a de-acidified oil feedstock, wherein
the oil feedstock comprises naphthenic acids;
the alkali metal in its metallic state is formed in situ in said chamber from alkali metal ions; and
the de-acidified oil feedstock has a TAN value that is lower than a TAN value of the oil feedstock.

2. The method as in claim 1, wherein the alkali metal in its metallic state comprises lithium, sodium and/or alloys thereof.

3. The method of claim 1, wherein the alkali metal in its metallic state further reacts with heteroatoms/heavy metals found within the oil feedstock such that a heteroatom to carbon ratio of the de-acidified oil feedstock is less than a heteroatom to carbon ratio of the oil feedstock.

4. The method of claim 3, further comprising an upgradant hydrocarbon that reacts with the oil feedstock such that the de-acidified oil feedstock has a greater energy value than an energy value of the oil feedstock.

5. The method as in claim 4, wherein the upgradant hydrocarbon comprises hydrogen gas, methane, ethane, propane, butane, pentane, ethene, propene, butene, pentene, dienes, isomers of the forgoing, and/or mixtures thereof.

6. The method as in claim 1, wherein the reaction occurs at a temperature that is greater than the melting point of the alkali metal in its metallic state but is lower than 450° C.

7. The method as in claim 1, wherein the reacting occurs at a pressure greater than about 250 psi but at a pressure that is less than about 2500 psi.

8. A method of upgrading an oil feedstock comprising:
obtaining a first oil feedstock that comprises a quantity of heavy metals, naphthenic acid and at least one heteroatom;
reacting the first oil feedstock with a first quantity of an alkali metal, wherein the alkali metal removes heavy metals from the first oil feedstock;
reacting the first oil feedstock with a second quantity of an alkali metal, wherein the second quantity of the alkali metal reacts with the naphthenic acid to form a de-acidified oil feedstock, wherein a TAN value of the first oil feedstock is less than a TAN value of the de-acidified oil feedstock;
reacting the de-acidified oil feedstock with a third quantity of an alkali metal, wherein the third quantity of the alkali metal reacts with the at least one heteroatom to form an upgraded oil feedstock, wherein a heteroatom to carbon ratio of the upgraded oil feedstock is less than a heteroatom to carbon ratio of the first oil feedstock.

9. The method of claim 8, wherein the reactions with the first, second and third quantities of the alkali metal all occur within a same chamber.

10. The method of claim 8, wherein the reactions with the first, second and third quantities of the alkali metal all occur within different chambers.

11. The method of claim 8, wherein the heavy metals are separated from the first oil feedstock before the second quantity of the alkali metal is reacted with the first oil feedstock.

12. A method of de-acidifying an oil feedstock comprising:
passing alkali metal ions from an alkali metal source chamber through an ion separator into a chamber containing an oil feedstock;
reducing the alkali metal ions in the oil feedstock chamber to alkali metal in its metallic state; and
reacting the oil feedstock with the in-situ produced alkali metal in its metallic state to form a de-acidified oil feedstock.

13. The method of claim 12, wherein passing the alkali metal ions through the ion separator to the oil feedstock and reducing the alkali metal ions to its metallic state comprises:
an anode that is at least partially housed in the alkali metal source;
a cathode that is at least partially housed within the oil feedstock; and
a power source applying a voltage to the anode and the cathode,
wherein applying the voltage across the anode causes the alkali metal ions to pass into the oil feedstock, and applying the voltage across the cathode reduces the alkali metal ions to its metallic state within the oil feedstock.

14. The method of claim 12 wherein the ion separator comprises ceramic materials, wherein the ceramic materials include Nasicon, sodium beta alumina, sodium beta prime alumnia, sodium ion conductive glass, Lisicon, lithium beta alumina, lithium beta prime alumina, or lithium ion conductive glass.

15. The method of claim 13 wherein the alkali metal ions include sodium ions, lithium ions, and/or a mixture thereof.

16. The method of claim 12 wherein the alkali metal source include an alkali metal solution comprising sodium sulfide, lithium sulfide, sodium chloride, or sodium hydroxide.

* * * * *